US009108436B1

(12) United States Patent
Yamamoto et al.

(10) Patent No.: US 9,108,436 B1
(45) Date of Patent: Aug. 18, 2015

(54) THERMAL PRINTER

(71) Applicant: MITSUBISHI ELECTRIC CORPORATION, Tokyo (JP)

(72) Inventors: Yoshifumi Yamamoto, Tokyo (JP); Akihito Ito, Tokyo (JP); Osamu Asano, Tokyo (JP); Kosuke Oda, Tokyo (JP); Masatomo Sakaguchi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/594,898

(22) Filed: Jan. 12, 2015

(30) Foreign Application Priority Data

Jan. 20, 2014 (JP) ..... 2014-007717

(51) Int. Cl.
*B41J 3/60* (2006.01)
*B41J 13/00* (2006.01)
*B41J 11/00* (2006.01)

(52) U.S. Cl.
CPC ..... *B41J 11/00* (2013.01); *B41J 13/009* (2013.01)

(58) Field of Classification Search
USPC ..... 347/218
See application file for complete search history.

(56) References Cited

U.S. PATENT DOCUMENTS 8,599,229 B1 12/2013 Mindler et al.
8,599,230 B1 12/2013 Mindler et al.
8,885,003 B2 * 11/2014 Mindler et al. ..... 347/176

FOREIGN PATENT DOCUMENTS

JP 11-151840 * 6/1999 ..... B41J 3/60
JP 2006-256119 A 9/2006
JP 2011-093255 A 5/2011
JP 2011-110789 A 6/2011
JP 2011-143628 A 7/2011

OTHER PUBLICATIONS

Computer-generated translation of JP 11-151840, published on Jun. 1999.*

* cited by examiner

*Primary Examiner* — Huan Tran
(74) *Attorney, Agent, or Firm* — Birch, Stewart, Kolasch & Birch, LLP

(57) ABSTRACT

A thermal printer of the present invention includes: a thermal head; a platen roller disposed to face the thermal head; a first path that guides a recording paper drawn from a recording paper roll to one entrance of a gap between the thermal head and the platen roller such that a first main surface of the recording paper is on the thermal head side; a second path that guides the recording paper drawn from the recording paper roll to the other entrance of the gap between the thermal head and the platen roller such that a second main surface of the recording paper is on the thermal head side; and a switch guide that switches between the first path and the second path.

6 Claims, 13 Drawing Sheets

THERMAL PRINTER

BACKGROUND OF THE INVENTION

1. Field of the Invention

The present invention relates to a thermal printer and more particularly to a thermal printer that performs double-sided printing.

2. Description of the Background Art

Thermal printers (also referred to as thermal transfer printers or sublimation printers) are known that have a function of performing printing on both sides of recording paper, the thermal printers thermally transferring ink from an ink sheet to the recording paper for printing. Japanese Patent Application Laid-Open No. 2011-93255 discloses a technique for reversing a rolled recording medium by a reversal means to perform printing on both sides of the recording paper.

With a technique disclosed in Japanese Patent Application Laid-Open No. 2011-110789, recording paper drawn from a rolled recording medium to be cut is guided into a gap between a thermal head and a platen roller in one direction for printing on one main surface of the recording paper. Next, the recording paper is turned upside down and is guided into the gap between the thermal head and the platen roller in the other direction for printing on the other main surface of the recording paper.

The technique disclosed in Japanese Patent Application Laid-Open No. 2011-93255 has the reversal means of reversing the rolled recording medium, resulting in an increased size of the device. Moreover, the reversal means makes an inner mechanism complex, resulting in an increased manufacturing cost.

The technique disclosed in Japanese Patent Application Laid-Open No. 2011-110789 transports, to the inside of the thermal printer, the recording paper drawn from the rolled recording medium to be cut, so that rollers for transporting the recording paper are needed to be disposed at relatively narrow intervals, resulting in the increased number of components.

SUMMARY OF THE INVENTION

It is an object of the present invention to provide a thermal printer capable of performing double-sided printing in a simple configuration.

A thermal printer of the present invention includes: a thermal head; a platen roller disposed to face the thermal head; a first path that guides a recording paper drawn from a recording paper roll to one entrance of a gap between the thermal head and the platen roller such that a first main surface of the recording paper is on the thermal head side; a second path that guides the recording paper drawn from the recording paper roll to the other entrance of the gap between the thermal head and the platen roller such that a second main surface of the recording paper is on the thermal head side; and a switch guide that switches between the first path and the second path.

The thermal printer of the present invention can perform double-sided printing in the simple configuration since the two paths, namely, the first path and the second path are provided and can be switched therebetween by the switch guide, the first path and the second path respectively guiding the first main surface and the second main surface of the recording paper drawn from the recording paper roll to the gap between the thermal head and the platen roller so as to be on the thermal head side.

These and other objects, features, aspects and advantages of the present invention will become more apparent from the following detailed description of the present invention when taken in conjunction with the accompanying drawings.

DESCRIPTION OF THE PREFERRED EMBODIMENT

First Preferred Embodiment

Figure 1:
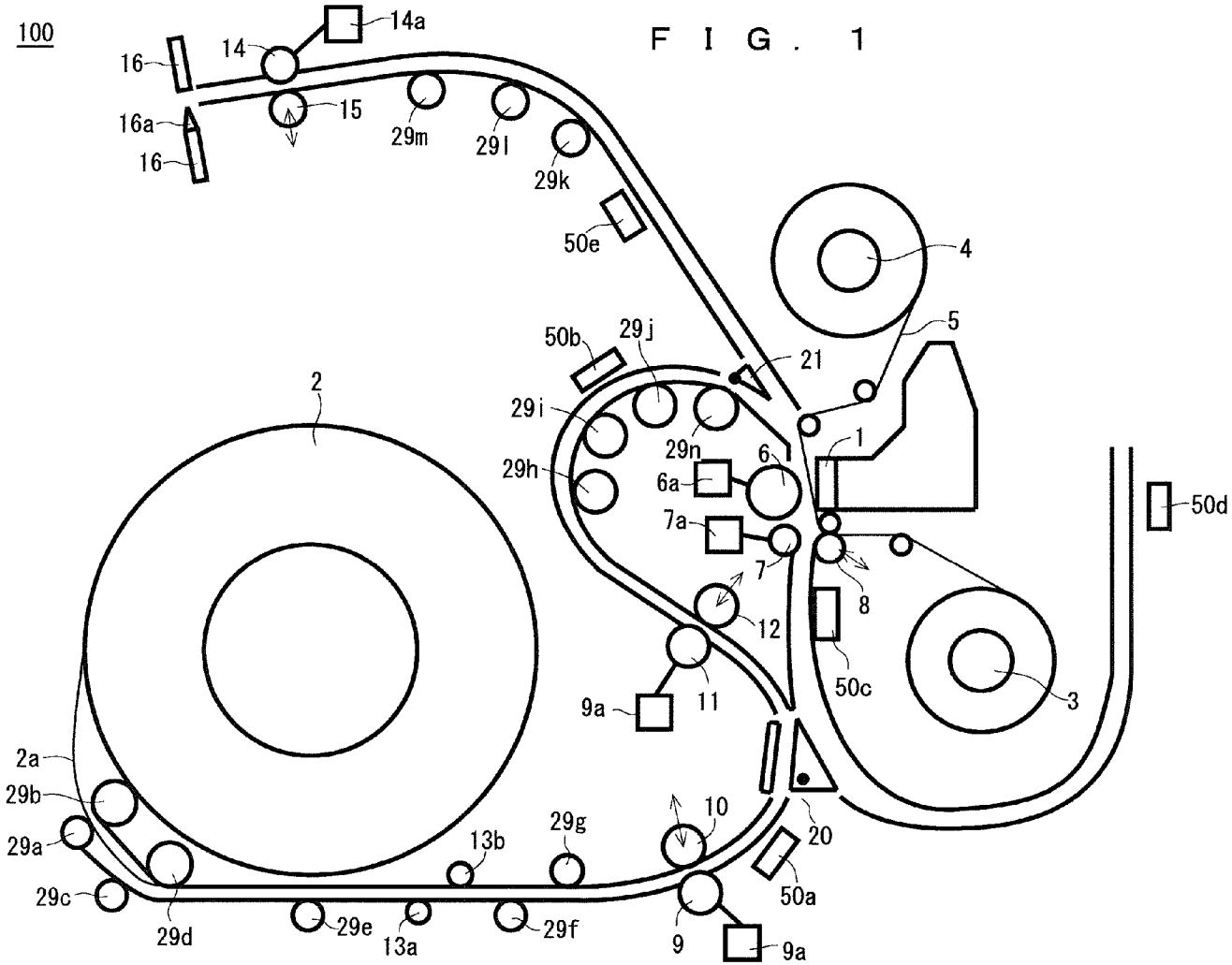
FIG. 1 is a cross-sectional view of a thermal printer according to a preferred embodiment of the present invention.
Figure 2:
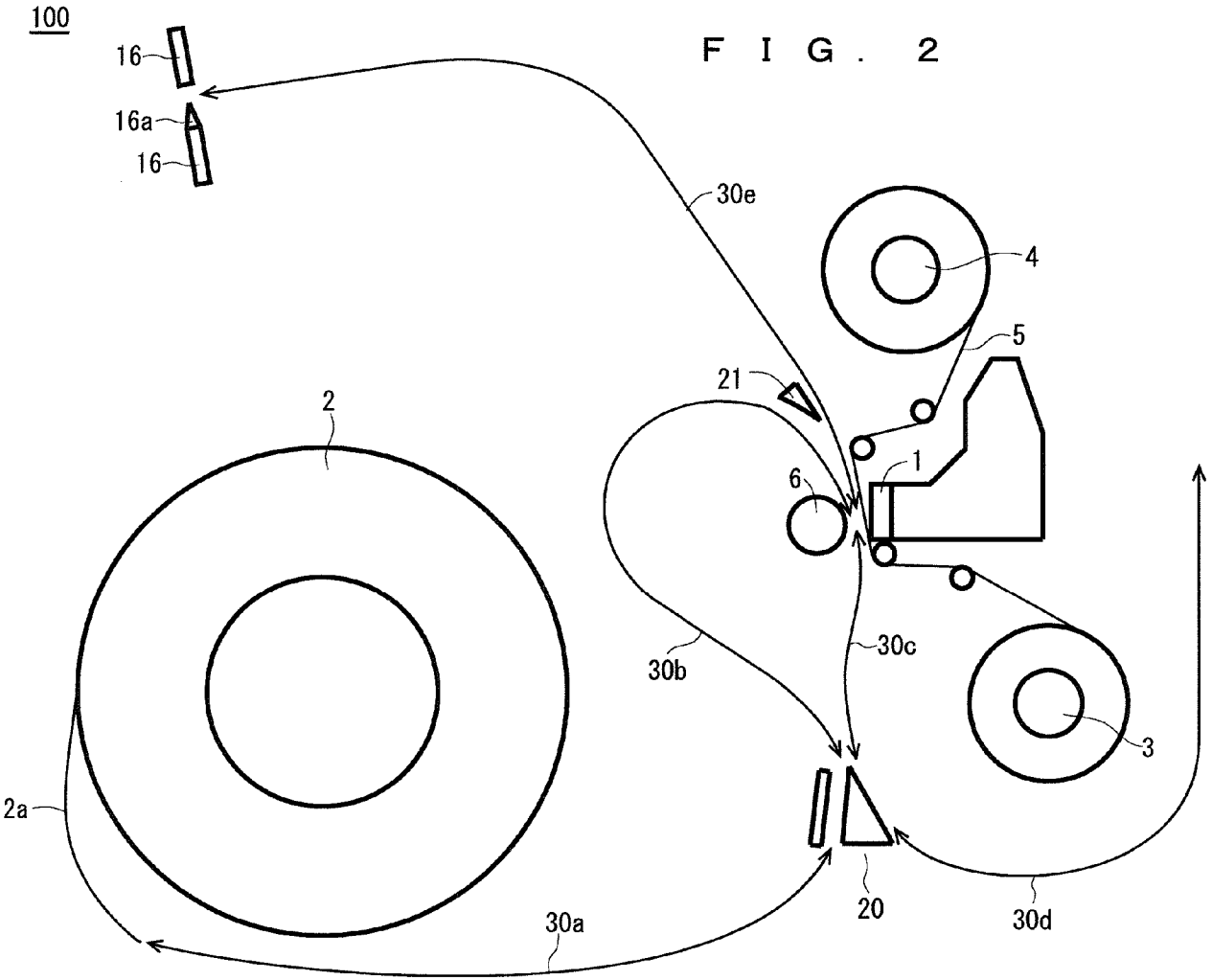
FIG. 2 is a diagram illustrating a transport path of recording paper shown in FIG. 1.

FIG. 1 is a diagram showing a configuration of a thermal printer 100 according to a preferred embodiment of the present invention. FIG. 2 is a diagram illustrating a transport path of recording paper in the thermal printer 100 in FIG. 1. As shown in FIG. 1, the thermal printer 100 includes a thermal head 1 and a platen roller 6 disposed to face the thermal head 1. Moreover, the thermal printer 100 includes an ink sheet winding bobbin 3 that winds an ink sheet 5 and an ink sheet unwinding bobbin 4 that unwinds the ink sheet 5. A recording paper roll 2 in which recording paper 2*a* is rolled up in a roll shape is set in the thermal printer 100.

As shown in FIG. 2, the thermal printer 100 includes a guide path 30*a* that guides the recording paper 2*a* drawn from the recording paper roll 2 to a switch guide 20. The thermal printer 100 includes a first path 30*b* that guides a first main surface (namely, back side) of the recording paper 2*a* to one entrance of a gap between the thermal head 1 and the platen roller 6 so as to be on the thermal head 1 side. The thermal printer 100 includes a second path 30*c* that guides a second main surface (namely, front side) of the recording paper 2*a* drawn from the recording paper roll 2 to the other entrance of the gap between the thermal head 1 and the platen roller 6 so as to be on the thermal head 1 side.

The thermal printer 100 further includes the switch guide 20 that switches between the first path 30*b* and the second path 30*c*. The switch guide 20 will be described below.

The thermal printer 100 further includes an auxiliary guide 21 that supports the transport path of the recording paper 2*a*. The auxiliary guide 21 will be described below.

The thermal printer 100 further includes a housing path 30*d* that houses the recording paper 2*a* guided to the one entrance of the gap between the thermal head 1 and the platen roller 6 from the first path 30*b* for printing. The housing path 30*d* is curved in the same direction as the winding direction of the recording paper roll 2.

The thermal printer 100 further includes an ejection path 30*e* that guides the recording paper 2*a* to an ejection opening 16, the recording paper 2*a* having passed through the second path 30*c*. The ejection opening 16 is provided with a cutter 16*a* that cuts the recording paper 2*a*. In the preferred embodiment, the ejection path 30*e* has a distance greater than an effective print length in a unit screen of the ink sheet 5 used in the thermal printer 100. Here, the distance of the ejection path 30*e* is the distance of the transport path from the gap between the thermal head 1 and the platen roller to the ejection opening 16.

A yellow (Y) region in the unit screen, a magenta (M) region in the unit screen, a cyan (C) region in the unit screen, and an overcoat (OP) region in the unit screen are disposed in the stated order as one group that is repeatedly disposed to form the ink sheet 5. Margins (for example, 10 mm) that are not used for printing are provided at both ends of the ink sheet 5 in a longitudinal direction in each unit screen. A region except for the margins in each unit screen is an effective print region used for printing. The length of the effective print region in the longitudinal direction of the ink sheet 5 in each unit screen is referred to as the effective print length.

The guide path 30*a* includes a paper feed roller 9 that transports the recording paper 2*a* and a pinch roller 10 that faces the paper feed roller 9. A paper feed motor 9*a* drives the paper feed roller 9. A cam, which is not shown, changes a position of the pinch roller 10 between a state where the pinch roller 10 is pressed against the paper feed roller 9 and a state where the pinch roller 10 is kept a distance from the paper feed roller 9. A motor rotates the cam, the motor and the cam not being shown.

The guide path 30*a* includes guide rollers 29*a*, 29*b*, 29*c*, 29*d*, 29*e*, 29*f*, 29*g* that smoothly transport the recording paper 2*a*. A first sensor 50*a* is provided upstream of the switch guide 20 in the guide path 30*a*.

The guide path 30*a* includes a dust removing roller 13*a* and a dust removing roller 13*b*. The dust removing rollers 13*a* and 13*b* are made of, for example, silicon and remove dust adhering to the recording paper 2*a*.

The first path 30*b* includes a paper feed roller 11 that transports the recording paper 2*a* and a pinch roller 12 that faces the paper feed roller 11. A paper feed motor 9*a* common to the paper feed roller 9 rotates the paper feed roller 11. A cam, which is not shown, changes a position of the pinch roller 12 between a state where the pinch roller 12 is pressed against the paper feed roller 11 and a state where the pinch roller 12 is kept a distance from the paper feed roller 11. A motor rotates the cam, the motor and the cam not being shown.

The first path 30*b* includes guide rollers 29*h*, 29*i*, 29*j*, 29*n* that smoothly transport the recording paper 2*a*. A second sensor 50*b* is provided, for example, between the guide roller 29*i* and the guide roller 29*j* in the first path 30*b*.

The second path 30*c* includes a grip roller 7 that transports the recording paper 2*a* and a pinch roller 8 that faces the grip roller 7. A transport motor 7*a* rotates the grip roller 7. A cam, which is not shown, changes a position of the pinch roller 8 between a state where the pinch roller 8 is pressed against the grip roller 7 and a state where the pinch roller 8 is kept a distance from the grip roller 7. A motor rotates the cam, the motor and the cam not being shown. A third sensor 50*c* is provided upstream of the pinch roller 8 in the second path 30*c*.

The housing path 30*d* includes a fourth sensor 50*d* at its end opposite to the switch guide 20.

The ejection path 30*e* includes a paper ejection roller 14 that transports the recording paper 2*a* and a pinch roller 15 that faces the paper ejection roller 14. A paper ejection motor 14*a* rotates the paper ejection roller 14. A cam, which is not shown, changes a position of the pinch roller 15 between a state where the pinch roller 15 is pressed against the paper ejection roller 14 and a state where the pinch roller 15 is kept a distance from the paper ejection roller 14. A motor rotates the cam, the motor and the cam not being shown.

The ejection path 30*e* includes guide rollers 29*k*, 291, 29*m* that smoothly transport the recording paper 2*a*. A fifth sensor 50*e* is provided between the auxiliary guide 21 and the guide roller 29*k* in the ejection path 30*e*.

The paper feed motor 9*a* and the transport motor 7*a* are stepping motors and are driven by drive pulses sent from a motor controller 60, which will be described below. The paper ejection motor 14*a* is a DC motor and is driven by the motor controller 60.

The motors (not shown) that rotate the cams to change the positions of the pinch rollers 8, 10, 12, and 15, the motor that rotates the recording paper roll 2, the motor that rotates the ink sheet winding bobbin 3, and the motor that rotates the ink sheet unwinding bobbin 4 for unwinding the ink sheet 5 are the DC motors and are driven by the motor controller 60, which will be described below.

<Switch Guide>

Figure 3A:
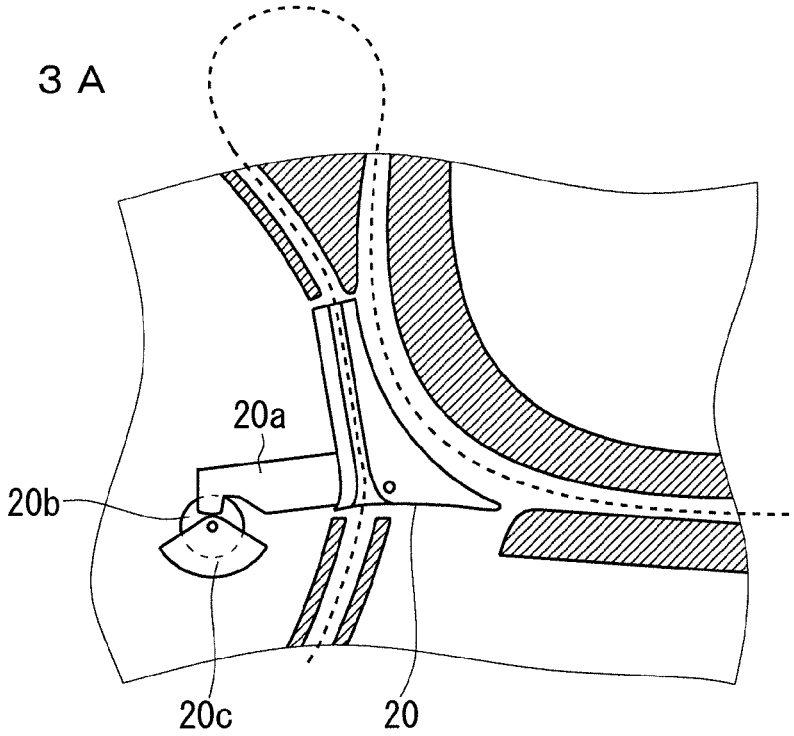
FIGS. 3A and 3B are diagrams showing a configuration and operations of a switch guide in the thermal printer according to the preferred embodiment of the present invention.
Figure 3B:
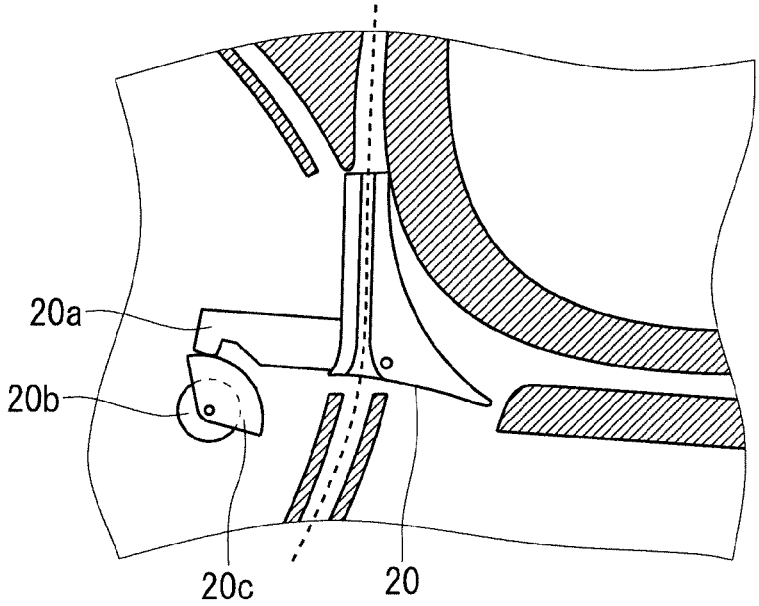

FIGS. 3A and 3B are diagrams showing a configuration and operations of the switch guide 20 in the thermal printer 100. In FIGS. 3A and 3B, a broken line illustrates the transport path of the recording paper 2*a*. FIG. 3A shows a state where the switch guide 20 connects the guide path 30*a* to the first path 30*b*, namely, the state where the switch guide 20 selects the first path 30*b*. In the state where the switch guide 20 selects the first path 30*b*, the second path 30*c* is simultaneously connected to the housing path 30*d*.

On the other hand, FIG. 3B shows a state where the switch guide 20 connects the guide path 30*a* to the second path 30*c*, namely, the state where the switch guide 20 selects the second path 30*c*.

As shown in FIGS. 3A and 3B, a switch guide motor 20*b* rotates a cam 20*c* to change an angle of a lever 20*a* pressed against the cam 20*c*. The lever 20*a* is fixed to the switch guide 20, so that a change in the angle of the lever 20*a* changes the angle of the switch guide 20 to cause the state shown in FIG. 3A or FIG. 3B.

<Auxiliary Guide>

Figure 4A:
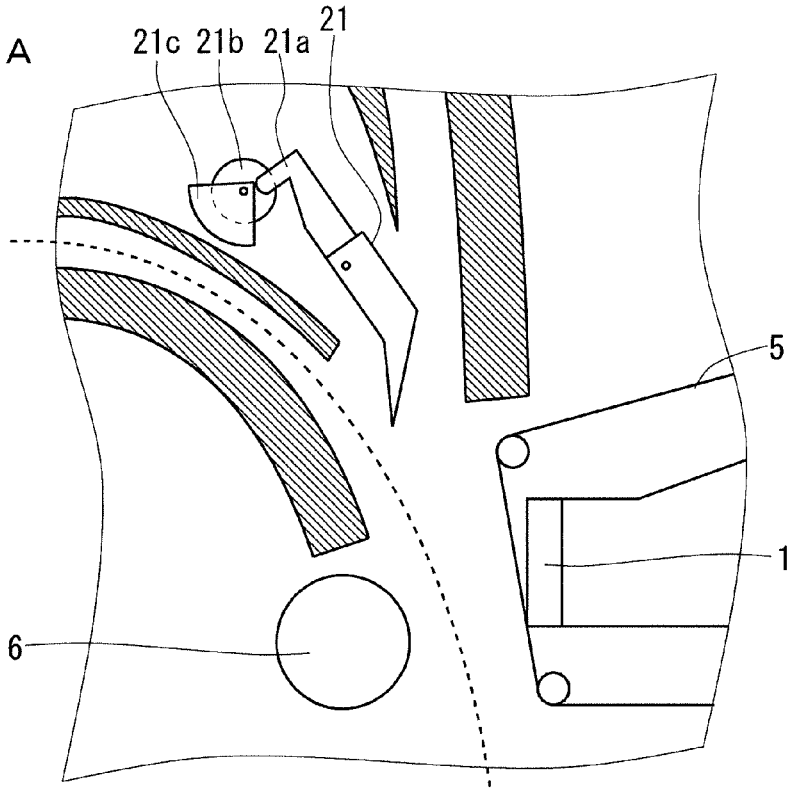
FIGS. 4A and 4B are diagrams showing a configuration and operations of an auxiliary guide in the thermal printer according to the preferred embodiment of the present invention.
Figure 4B:
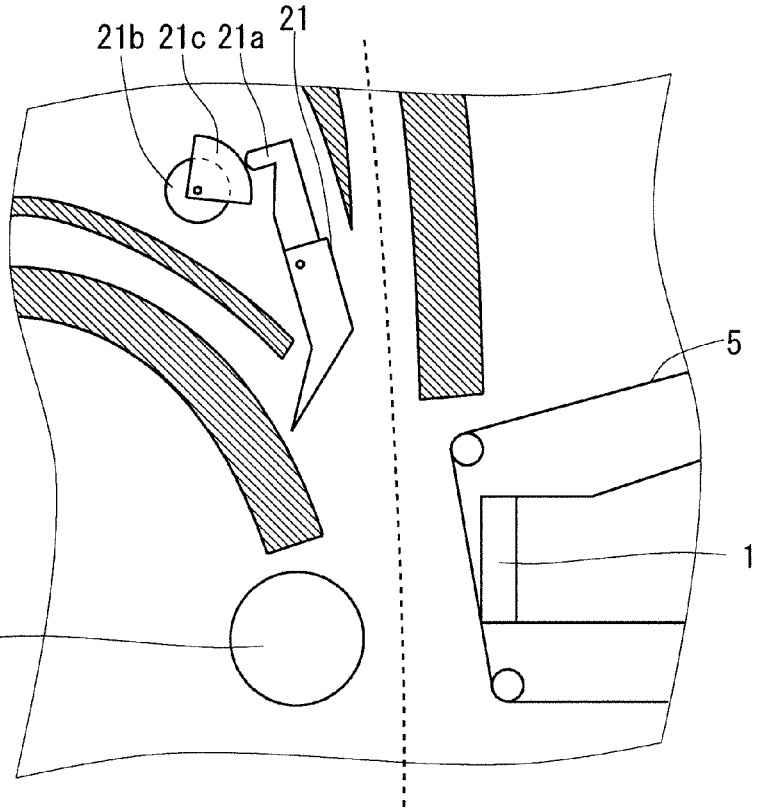

FIGS. 4A and 4B are diagrams showing a configuration and operations of the auxiliary guide 21 in the thermal printer 100. In FIGS. 4A and 4B, a broken line illustrates the transport path of the recording paper 2*a*. FIG. 4A shows a state where the auxiliary guide 21 supports the transport path such that the first path 30*b* is smoothly connected to the other entrance of the gap between the thermal head 1 and the platen roller 6. In other words, it is the state where the auxiliary guide 21 selects the first path 30*b*.

On the other hand, FIG. 4B shows a state where the auxiliary guide 21 supports the transport path such that the ejection path 30*e* is smoothly connected to the other entrance of the gap between the thermal head 1 and the platen roller 6. In other words, it is the state where the auxiliary guide 21 selects the ejection path 30*e*.

As shown in FIGS. 4A and 4B, an auxiliary guide motor 21*b* rotates a cam 21*c* to change an angle of a lever 21*a* pressed against the cam 21*c*, causing a change in the angle of the auxiliary guide 21. The lever 21*a* is fixed to the auxiliary guide 21, so that the change in the angle of the auxiliary guide 21 causes the state shown in FIG. 4A or FIG. 4B.

<Functional Block Diagram>

Figure 5:
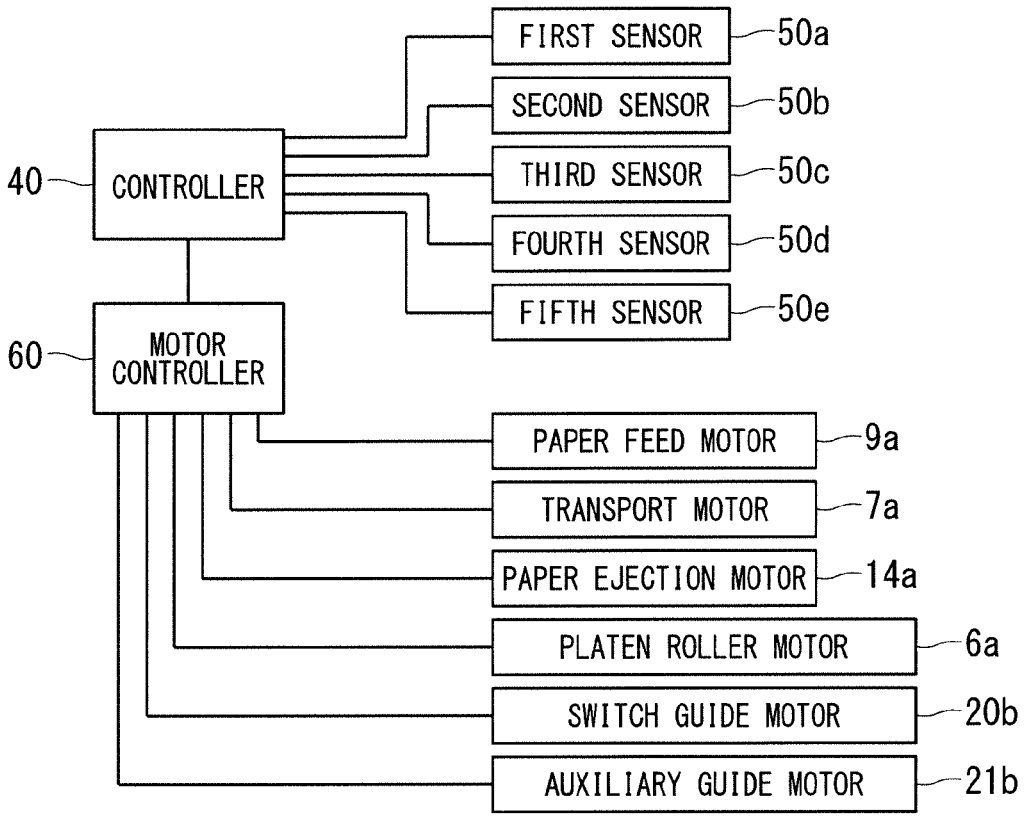
FIG. 5 is a functional block diagram of the thermal printer according to the preferred embodiment of the present invention.

FIG. 5 is a functional block diagram of the thermal printer 100 according to the preferred embodiment of the present invention. The thermal printer 100 includes a controller 40 that controls printing operations. The controller 40 receives detection signals for indicating the detection of the recording paper 2*a* from a first sensor 50*a*, a second sensor 50*b*, a third sensor 50*c*, a fourth sensor 50*d*, and a fifth sensor 50*e*. The thermal printer 100 includes the motor controller 60 that controls each motor in the thermal printer 100. The controller 40 controls the motor controller 60 in response to the detection signals sent from the first sensor 50*a*, the second sensor 50*b*, the third sensor 50*c*, the fourth sensor 50*d*, and the fifth sensor 50*e*. The motor controller 60 outputs the drive pulses for driving each stepping motor in the thermal printer 100. As shown in FIG. 5, the motor controller 60 sends the drive pulses to the paper feed motor 9*a* and the transport motor 7*a*. Moreover, the paper ejection motor 14*a*, a platen roller motor 6*a* that rotates the platen roller 6, the switch guide motor 20*b*, and the auxiliary guide motor 21*b* are the DC motors and are driven by the motor controller 60.

The motor controller 60 also drives the DC motors (not shown) that rotate the cams to change the positions of the pinch rollers 8, 10, 12, and 15. The motor controller 60 also drives the DC motors (not shown) that rotate the recording paper roll 2, the ink sheet winding bobbin 3, and the ink sheet unwinding bobbin 4.

To suppress slack in the recording paper 2*a* during transport, torque limiters are provided between the paper feed motor 9*a* and the paper feed rollers 9, 11 and between the paper ejection motor 14*a* and the paper ejection roller 14.

<Operations>

The thermal printer 100 of the preferred embodiment has a first print function (operation mode) of switching the switch guide 20 to the first path 30*b* (namely, causing the switch guide 20 to be in the state of FIG. 3A) and guiding the recording paper 2*a* into the first path 30*b* for printing on the first main surface (namely, back side) of the recording paper 2*a*.

The thermal printer 100 of the preferred embodiment further has a rewind function (operation mode) of rewinding the recording paper 2*a* on which printing has been performed by the first print function (operation mode).

The thermal printer 100 of the preferred embodiment further has a second print function (operation mode) of switching the switch guide 20 to the second path 30*c* (namely, causing the switch guide to be in the state of FIG. 3B) after the recording paper 2*a* has been rewound by the rewind function (operation mode) and guiding the recording paper 2*a* into the second path 30*c* for printing on the second main surface (namely, front side) of the recording paper 2*a*. Moreover, the thermal printer 100 of the preferred embodiment performs printing on both the first and second main surfaces of the recoding paper 2*a* being connected to the recording paper roll 2.

Figure 6:
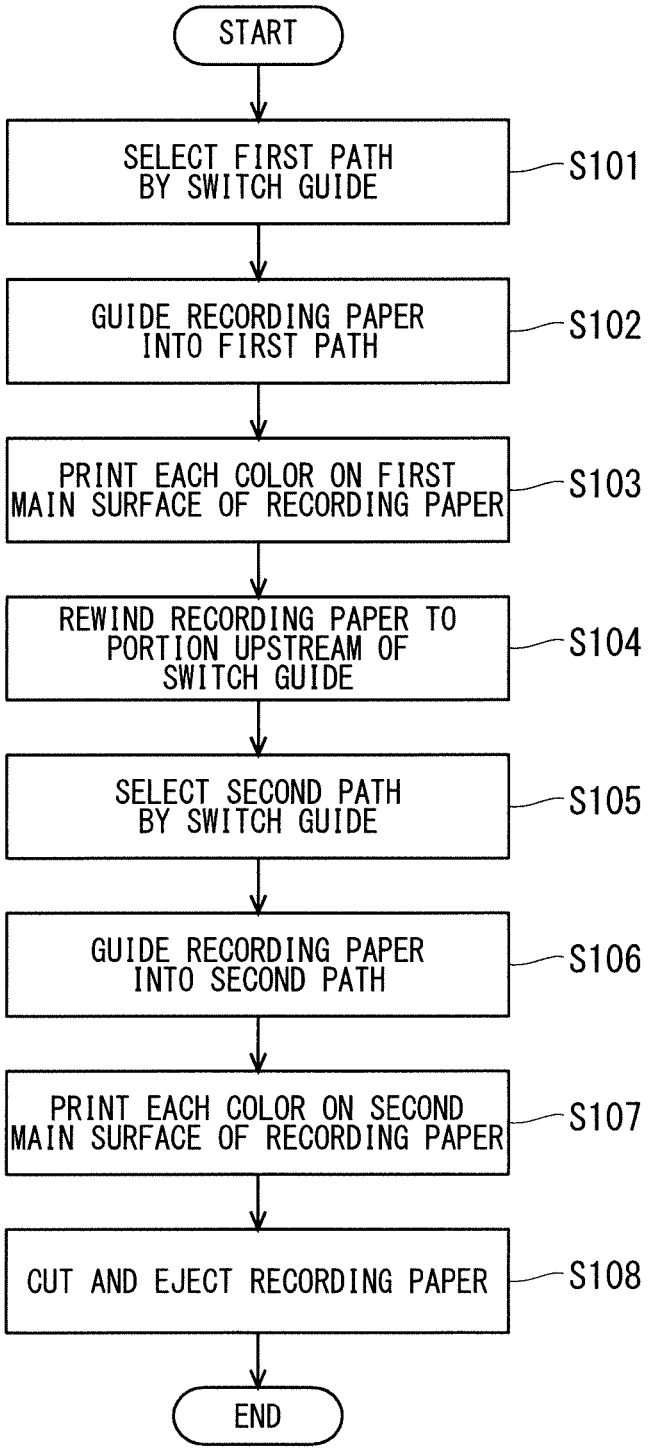
FIG. 6 is a flow chart showing printing operations of the thermal printer according to the preferred embodiment of the present invention.

FIG. 6 is a flow chart showing printing operations of the thermal printer 100. First, the thermal printer 100 performs printing on the first main surface of the recording paper 2*a* (steps S101 to S103 in FIG. 6). This corresponds to the first print function (operation mode). Next, the thermal printer 100 rewinds the recording paper 2*a* (step S104 in FIG. 6). This corresponds to the rewind function (operation mode). Then, the thermal printer 100 performs printing on the second main surface of the recording paper 2*a* (steps S105 to S107 in FIG. 6). This corresponds to the second print function (operation mode).

<Back-Side Printing Operations>

Figure 7:
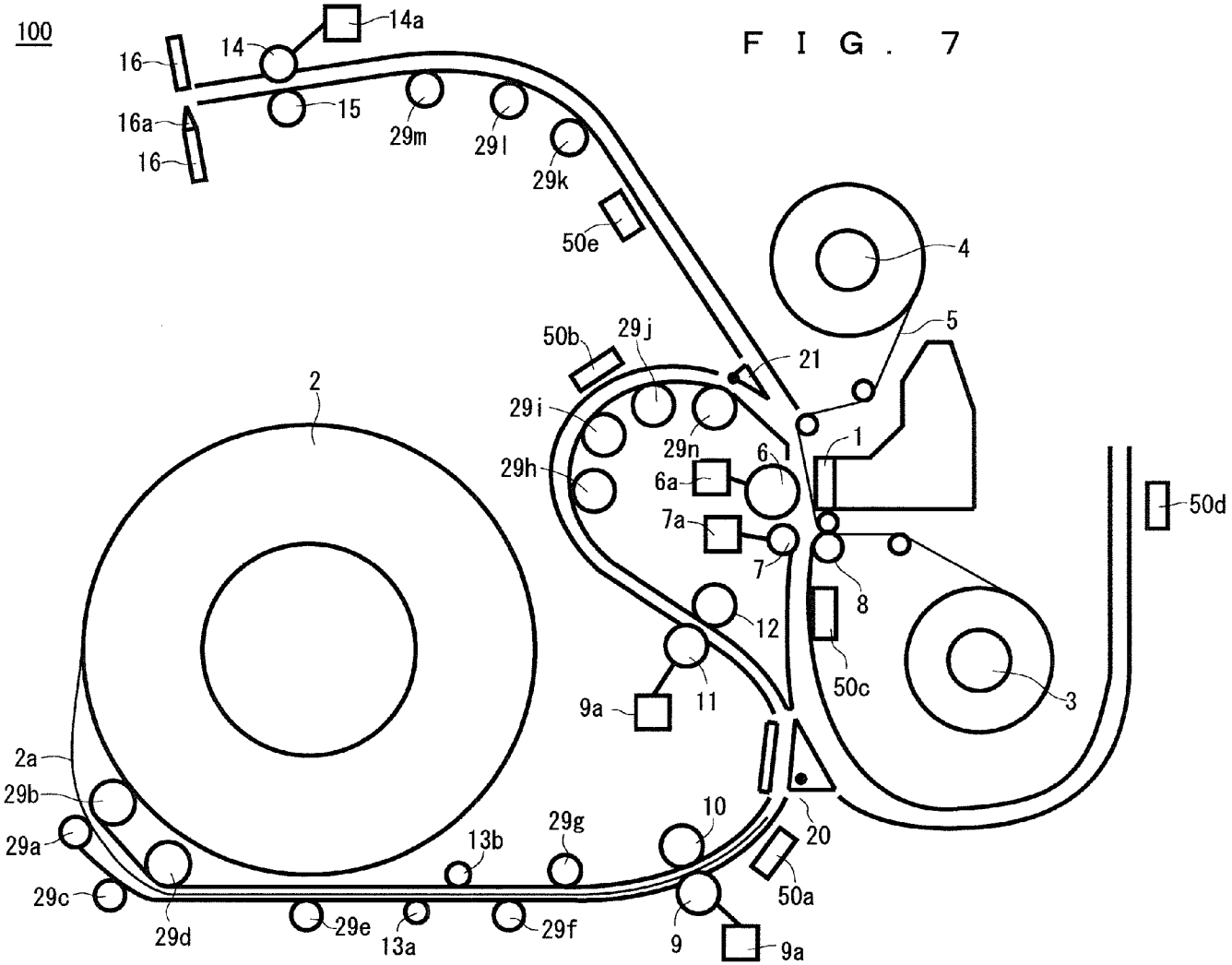
FIGS. 7 to 10 are diagrams explaining back-side printing operations of the thermal printer according to the preferred embodiment of the present invention.

First, back-side printing operations will be described below with reference to the flow chart of FIG. 6 and FIGS. 7 to 10. As shown in FIG. 7, a tip of the recording paper 2*a* is located at the position capable of being detected by the first sensor 50*a* in the initial state. At this time, only the first sensor 50*a* outputs the detection signal indicating the detection of the recording paper 2*a* while the other sensors (second to fifth sensors 50*b*, 50*c*, 50*d*, 50*e*) do not output the detection signals. In this initial state, the motor controller 60 controls the drive of the switch guide motor 20*b* and causes the switch guide 20 to select the first path 30*b* (step S101 in FIG. 6). In other words, the switch guide 20 is caused to be in the state of FIG. 3A. At the same time, the motor controller 60 causes the pinch roller 10 to be pressed against the paper feed roller 9 via the recording paper 2*a*. The motor controller 60 simultaneously causes the pinch roller 12 to be pressed against the paper feed roller 11. In addition, the motor controller 60 controls the drive of the auxiliary guide motor 21*b* and causes the auxiliary guide 21 to select the first path 30*b*. In other words, the auxiliary guide 21 is caused to be in the state of FIG. 4A.

Next, in the step S102 in FIG. 6, the motor controller 60 controls the drive of the paper feed motor 9*a* to rotate the paper feed roller 9, and thus the recording paper 2*a* passes through the switch guide 20 to be guided into the first path 30*b*. The motor, which is not shown, rotates the recording paper roll 2 in the transport direction in synchronization with the rotation of the paper feed roller 9. When the motor controller 60 outputs the predetermined number of drive pulses to the paper feed motor 9*a*, the recording paper 2*a* reaches the portion between the paper feed roller 11 and the pinch roller 12. The motor controller 60 continues to drive the paper feed motor 9*a*. When the recording paper 2*a* reaches the second sensor 50*b*, the second sensor 50*b* outputs the detection signal to the controller 40. When the controller 40 receives the detection signal from the second sensor 50*b*, the motor controller 60 drives the transport motor 7*a* to rotate the grip roller 7. If the detection signal is not output from the second sensor 50*b* despite the fact that the motor controller 60 outputs the drive pulses for the recording paper 2*a* to reach the second sensor 50*b*, the controller 40 gives a warning about a paper jam, for example, to a user.

Figure 8:
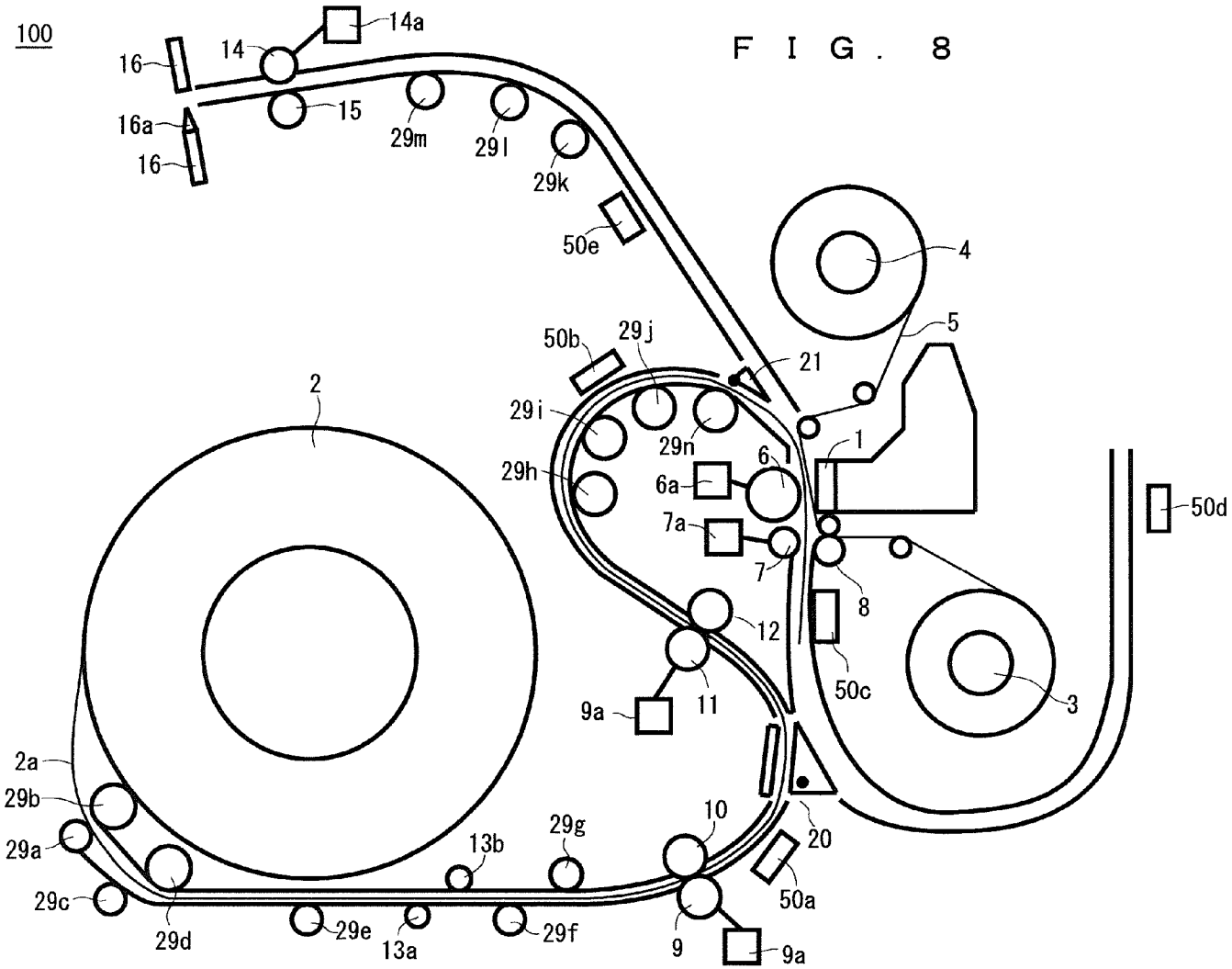

As the motor controller 60 continues to drive the paper feed motor 9*a*, the recording paper 2*a* is guided to the one entrance of the gap between the thermal head 1 and the platen roller 6. As the motor controller 60 continues to drive the paper feed motor 9*a*, the recording paper 2*a* passes through the gap between the thermal head 1 and the platen roller 6 to reach the third sensor 50*c*. FIG. 8 shows this state. The motor controller 60 rotates the ink sheet winding bobbin 3 and the ink sheet unwinding bobbin 4 to transport the screen of yellow (Y) of the ink sheet 5 to a printing position.

Figure 9:
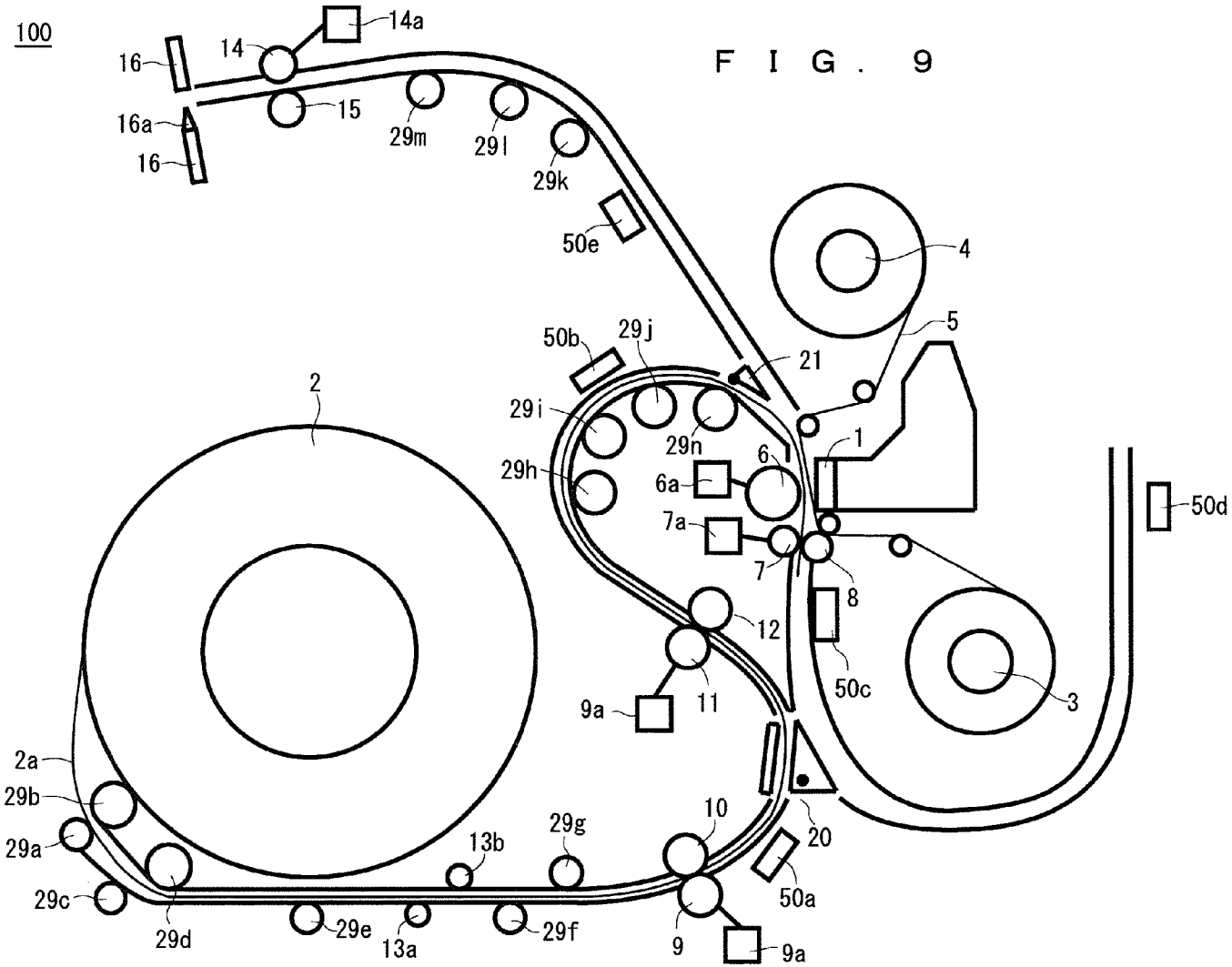

In the state shown in FIG. 8, the third sensor 50*c* outputs the detection signal. When receiving the detection signal from the third sensor 50*c*, the controller 40 stops the paper feed motor 9*a* and the transport motor 7*a*. At the same time, the pinch roller 8 is pressed against the grip roller 7 via the recording paper 2*a*. Then, the motor controller 60 controls the transport motor 7*a* to rotate the grip roller 7 and transports the recording paper 2*a* in the direction opposite to the direction from which the recording paper 2*a* is transported. At this time, the motor controller 60 also rotates the paper feed roller 9 and the paper feed roller 11 in synchronization with the rotation of the grip roller 7. When outputting the predetermined number of drive pulses to the transport motor 7*a*, the motor controller 60 stops the transport motor 7*a*. Then, the platen roller 6 is pressed against the thermal head 1 via the recording paper 2*a* and the ink sheet 5. FIG. 9 shows this state.

Figure 10:
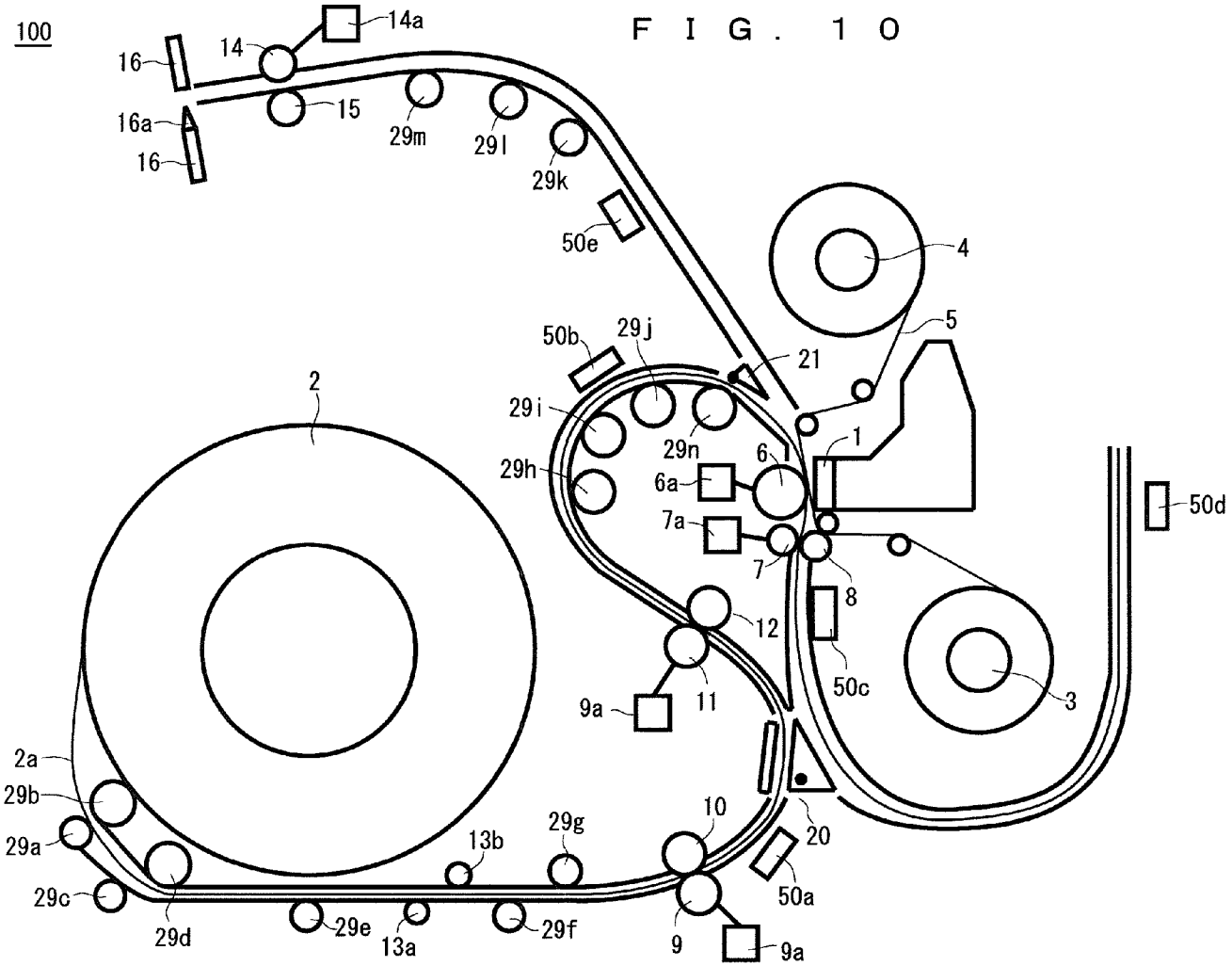

Next, in the step S103 in FIG. 6, printing on the first main surface (namely, back side) of the recording paper 2*a* is started. In other words, in the state of FIG. 9, the motor controller 60 transports the ink sheet 5 and also rotates the platen roller 6 and the grip roller 7 to transport the recording paper 2*a*. After the ink sheet 5 and the recording paper 2*a* have been transported by the predetermined number of drive pulses, the thermal head 1 is heated to start printing yellow (Y). The recording paper 2*a* on which yellow (Y) has been printed passes through the second path 30*c* and is housed in the housing path 30*d* via the switch guide 20. As the recording paper 2*a* is transported by the predetermined number of drive pulses, the ink sheet 5 is pressed against the recoding paper 2*a* and is transported, completing printing of yellow (Y). FIG. 10 shows this state.

In the state of FIG. 10, the fourth sensor 50*d* detects the recording paper 2*a* and outputs the detection signal. If the detection signal is not output from the fourth sensor 50*d* despite the fact that the printing of yellow (Y) is completed, the controller 40 gives a warning about a paper jam, for example, to the user.

Next, the motor controller 60 releases the thermal head 1 from the pressure of the platen roller 6 and rotates the grip roller 7 to rewind the recording paper 2*a* to the position shown in FIG. 8. At this time, the paper feed roller 9, the paper feed roller 11, and the recording paper roll 2 are also rotated in synchronization with the grip roller 7. The motor controller 60 rotates the ink sheet winding bobbin 3 and the ink sheet unwinding bobbin 4 to transport the screen of magenta (M) of the ink sheet 5 to a printing position. Then, magenta (M) is printed in the same operation as the printing of yellow (Y). Hereinafter, the similar printing operation is repeated to print cyan (C) and over coat (OP). This completes the printing on the first main surface (namely, back side) of the recording paper 2*a*.

<Front-Side Printing Operations>

Printing is performed on the second main surface (namely, front side) of the recording paper 2*a*, followed by the printing on the first main surface (namely, back side) of the recording paper 2*a*. Front-side printing operations will be described below with reference to the flow chart of FIG. 6 and FIGS. 11 to 13.

When the back-side printing operations are completed, the recording paper 2*a* is in the state of FIG. 10. The motor controller 60 releases the thermal head 1 from the pressure of the platen roller 6 and also releases the grip roller 7 from the pressure of the pinch roller 8. Then, the motor controller 60 rotates the recording paper roll 2 in the direction to which the recording paper 2*a* is rewound. The paper feed roller 9 and the paper feed roller 11 are rotated in synchronization with the rotation of the recording paper roll 2. As the recording paper 2*a* passes through the first sensor 50*a*, the detection signal output from the first sensor 50*a* is changed from present to absent. When the output of the first sensor 50*a* is changed, the motor controller 60 outputs the predetermined number of drive pulses and subsequently stops to transport the recording paper 2*a*. In the operations as described above, the recording paper 2*a* is rewound to the portion upstream of the switch guide 20 (step S104 in FIG. 6).

Figure 11:
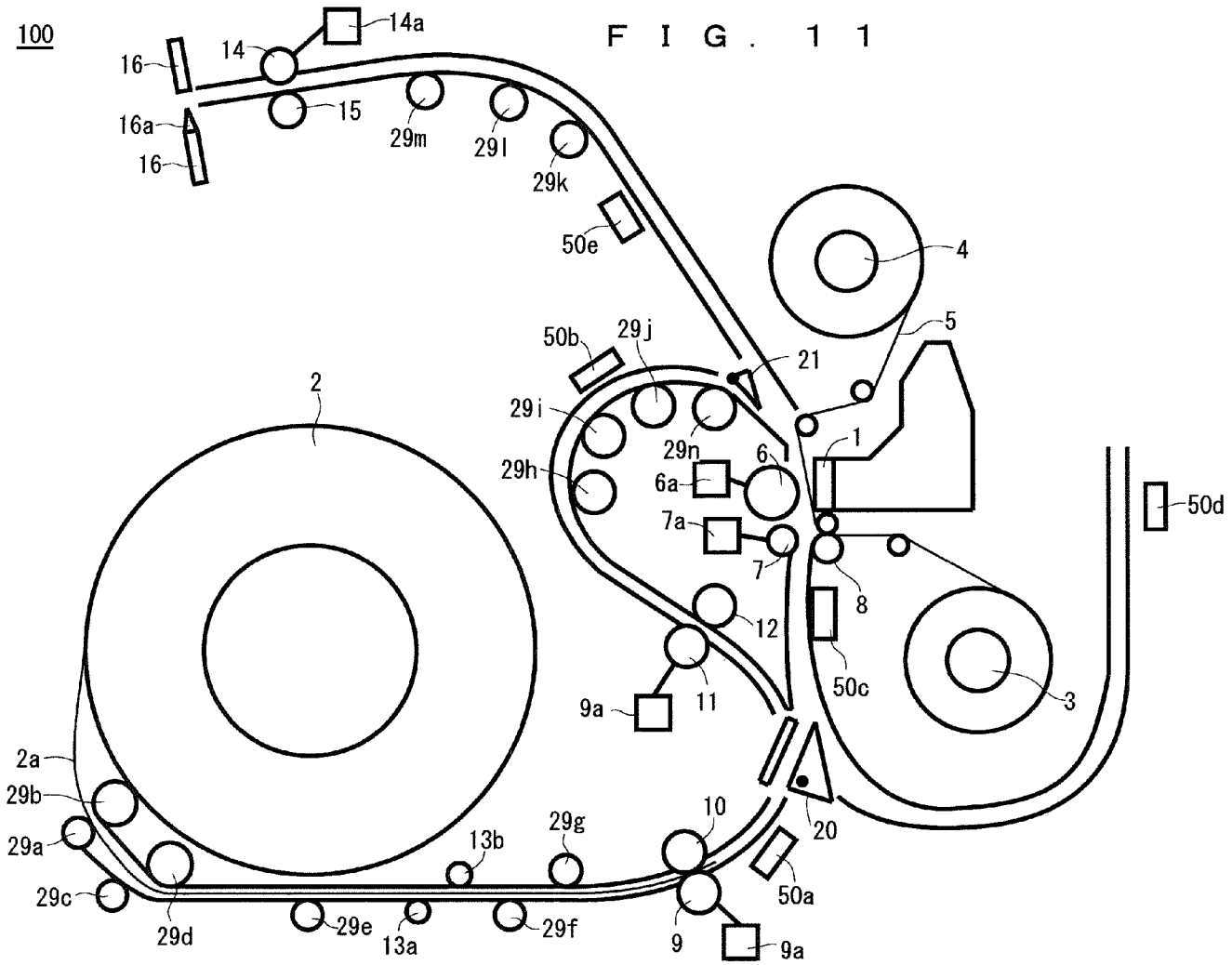
FIGS. 11 to 13 are diagrams explaining front-side printing operations of the thermal printer according to the preferred embodiment of the present invention.

Next, in the step S105 in FIG. 6, the motor controller 60 controls the drive of the switch guide motor 20*b* and causes the switch guide 20 to select the second path 30*c*. In other words, the switch guide 20 is caused to be in the state of FIG. 3B. At the same time, the motor controller 60 controls the drive of the auxiliary guide motor 20*b* and causes the auxiliary guide 21 to select the ejection path 30*e*. In other words, the auxiliary guide 21 is caused to be in the state of FIG. 4B. The motor controller 60 causes the pinch roller 10 to be pressed against the paper feed roller 9 via the recording paper 2*a*. FIG. 11 shows this state.

Figure 12:
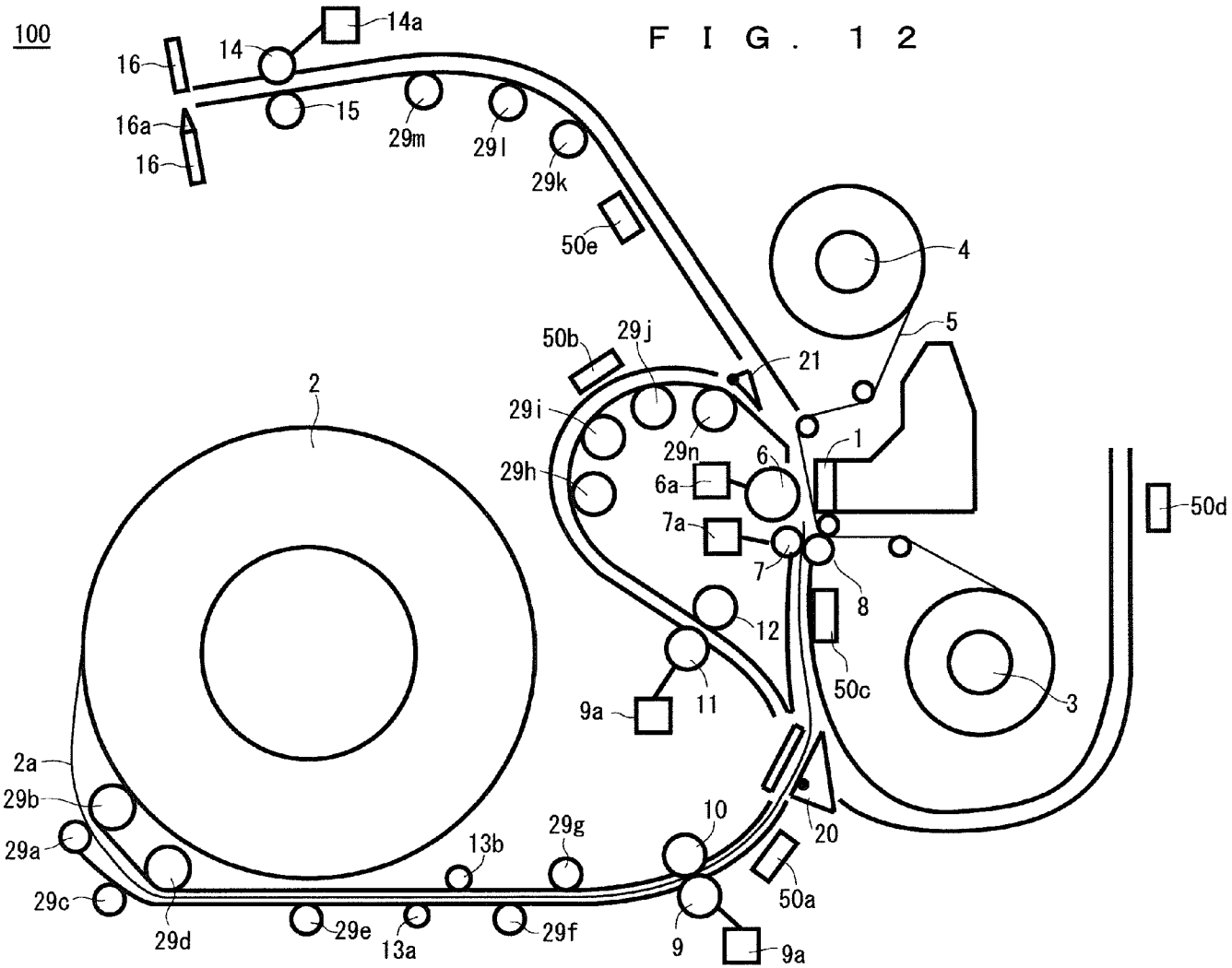

Next, in the step S106 in FIG. 6, the motor controller 60 controls the drive of the paper feed motor 9*a* to rotate the paper feed roller 9, and thus the recording paper 2*a* passes through the switch guide 20 to be guided into the second path 30*c*. When the recording paper 2*a* reaches the third sensor 50*c*, the third sensor 50*c* outputs the detection signal. When the controller 40 receives the detection signal from the third sensor 50*c*, the motor controller 60 further transports the recording paper 2*a* by the predetermined number of drive pulses. The motor controller 60 causes the pinch roller 8 to be pressed against the grip roller 7 via the recording paper 2*a*. FIG. 12 shows this state.

Figure 13:
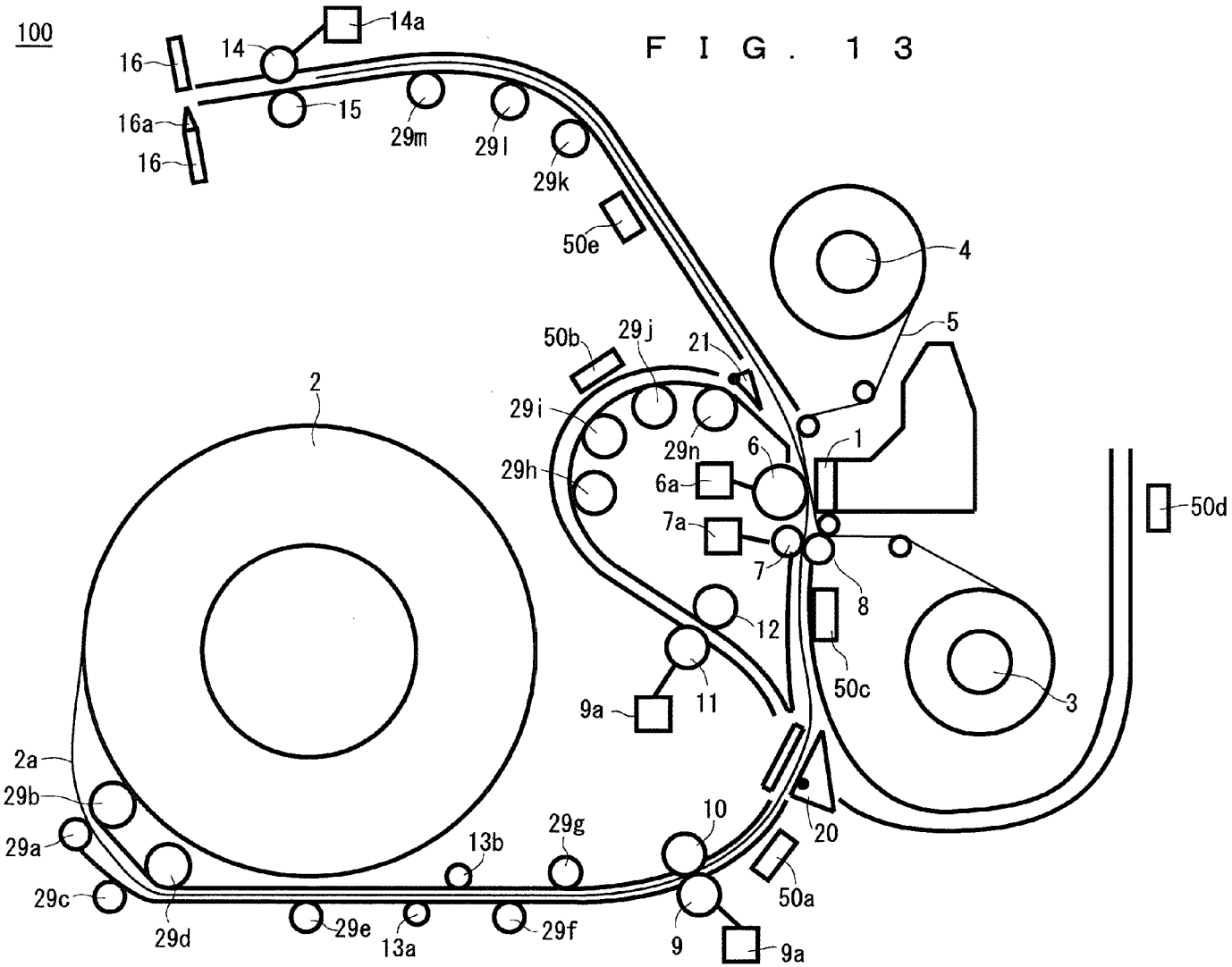

Furthermore, the motor controller 60 transports the recording paper 2*a*, and as the recording paper 2*a* reaches the fifth sensor 50*e*, the fifth sensor 50*e* outputs the detection signal. When the controller 40 receives the detection signal from the fifth sensor 50*e*, the motor controller 60 further transports the recording paper 2*a* by the predetermined number of drive pulses. Thus, the recording paper 2*a* is transported to a printing start position. The motor controller 60 rotates the ink sheet winding bobbin 3 and the ink sheet unwinding bobbin 4 to transport the screen of yellow (Y) of the ink sheet 5 to the printing position. The motor controller 60 causes the platen roller 6 to be pressed against the thermal head 1 via the recording paper 2*a* and the ink sheet 5. FIG. 13 shows this state. The recording paper 2*a* that has been transported to the printing start position does not reach the ejection opening 16.

Next, in the step S107 in FIG. 6, printing on the second main surface (namely, front side) of the recording paper 2*a* is started. In other words, in the state of FIG. 13, the motor controller 60 transports the ink sheet 5 and also rotates the platen roller 6 and the grip roller 7 to transport the recording paper 2*a* in the rewind direction while the thermal head 1 is heated to print yellow (Y). The recording paper 2*a* and the ink sheet 5 are transported by the predetermined number of drive pulses, completing printing of yellow (Y).

Next, the motor controller 60 releases the thermal head 1 from the pressure of the platen roller 6 and rotates the grip roller 7 to transport the recording paper 2*a* to the position shown in FIG. 13. At this time, the paper feed roller 9, the paper feed roller 11, and the recording paper roll 2 are also rotated in synchronization with the grip roller 7. The motor controller 60 rotates the ink sheet winding bobbin 3 and the ink sheet unwinding bobbin 4 to transport the screen of magenta (M) of the ink sheet 5 to the printing position. Then, magenta (M) is printed in the same operation as the printing of yellow (Y). Hereinafter, the similar printing operation is repeated to print cyan (C) and over coat (OP). This completes the printing on the second main surface (namely, back side) of the recording paper 2*a*.

After the completion of the printing on the second main surface (namely, front side) of the recording paper 2*a*, the motor controller 60 rotates the grip roller 7, the paper feed roller 9, and the recording paper roll 2 to transport the recording paper 2*a* to the ejection opening 16 while the motor controller 60 causes the pinch roller 8 to be pressed against the grip roller 7. When the recording paper 2*a* reaches the fifth sensor 50*e*, the fifth sensor 50*e* outputs the detection signal. The detection signal from the fifth sensor 50*e* is used to monitor a paper jam. The motor controller 60 causes the pinch roller 15 to be pressed against the paper ejection roller 14 via the recording paper 2*a*, rotates the paper ejection roller 14, the grip roller 7, the paper feed roller 9, and the recording paper roll 2, and further transports the recording paper 2*a* by the predetermined number of drive pulses. As a result, a portion of the recording paper 2*a* on which printing has been performed is exposed to the outside of the case of the thermal printer 100 from the ejection opening 16. Then, the recording paper 2*a* is cut with the cutter 16*a* provided at the ejection opening 16, and the printed matter is ejected from the ejection opening 16 (step S108 in FIG. 6).

<Effects>

The thermal printer 100 of the preferred embodiment includes: the thermal head 1; the platen roller 6 disposed to face the thermal head 1; the first path 30*b* that guides the recording paper 2*a* drawn from the recording paper roll 2 to the one entrance of the gap between the thermal head 1 and the platen roller 6 such that the first main surface of the recording paper 2*a* is on the thermal head 1 side; the second path 30*c* that guides the recording paper 2*a* drawn from the recording paper roll 2 to the other entrance of the gap between the thermal head 1 and the platen roller 6 such that the second main surface of the recording paper 2*a* is on the thermal head 1 side; and the switch guide 20 that switches between the first path 30*b* and the second path 30*c*.

Therefore, the thermal printer 100 of the preferred embodiment can perform double-sided printing in the simple configuration since the two paths, namely, the first path 30*b* and the second path 30*c* are provided and can be switched therebetween by the switch guide 20, the first path 30*b* and the second path 30*c* respectively guiding the first main surface and the second main surface of the recording paper 2*a* drawn from the recording paper roll 2 to the gap between the thermal head 1 and the platen roller 6. The thermal printer 100 of the preferred embodiment can perform printing on both the sides without the mechanism for reversing the recording paper roll 2, achieving double-sided printing in the more simple configuration than the conventional configuration. The thermal printer 100 has the more simple configuration than the conventional configuration, allowing for the miniaturization thereof. Moreover, the thermal printer 100 does not include the complex mechanism for reversing the recording paper roll 2, allowing for a reduced manufacturing cost.

After printing on the first main surface has been performed, the thermal printer 100 of the preferred embodiment rewinds the recording paper 2*a* around the recording paper roll 2 to subsequently perform printing on the second main surface, eliminating the need to cut the recording paper 2*a* during printing. This can reduce the number of rollers for transporting the recording paper 2*a* compared to the case where the recording paper 2*a* is cut during printing. In other words, the number of components is reduced compared to the conventional configuration, achieving the simplified configuration of the thermal printer 100. The number of components is reduced compared to the conventional configuration, achieving the miniaturization of the thermal printer 100.

The thermal printer 100 of the preferred embodiment further includes: the first print function of switching the switch guide 20 to the first path 30*b* and guiding the recording paper 2*a* into the first path 30*b* to perform printing on the first main surface of the recording paper 2*a*; the rewind function of rewinding the recording paper 2*a* on which printing has been performed by the first print function; and the second print function of switching the switch guide 20 to the second path 30*c* after the recording paper 2*a* has been rewound by the rewind function and guiding the recording paper 2*a* into the second path 30*c* to perform printing on the second main surface of the recording paper 2*a*. The thermal printer 100 performs printing on both the first and second main surfaces of the recording paper 2*a* being connected to the recording paper roll 2.

Therefore, the thermal printer 100 of the preferred embodiment has the first print function, whereby printing can be performed on the first main surface of the recording paper 2*a* using the first path 30*b*. The thermal printer 100 has the rewind function, whereby the recording paper 2*a* having the first main surface on which printing has been performed can be rewound around the recording paper roll 2. The thermal printer 100 has the second print function, whereby printing can be performed on the second main surface of the recording paper 2*a* using the second path 30*c*.

The thermal printer 100 of the preferred embodiment performs printing on both the first and the second main surfaces of the recording paper 2*a* being connected to the recording paper roll 2. This can reduce the number of rollers for transporting and rewinding the recording paper 2*a* compared to the case where printing is performed on the first and second main surfaces of the recording paper 2*a* that has been cut from the recording paper roll 2. The reduction in the number of components can lead to the miniaturization of the thermal printer 100 and the reduced manufacturing cost.

The thermal printer 100 further includes the housing path 30*d* that houses the recording paper 2*a* on which printing has been performed by the first print function. The housing path 30*d* is curved in the same direction as a winding direction of the recording paper roll 2.

Therefore, the housing path 30*d* that houses the recording paper 2*a* on which printing has been performed by the first print function can prevent a stain and dust from adhering to the recording paper 2*a* compared to the case where the housing path 30*d* is not provided and the recording paper 2*a* is exposed to the outside of the case. Furthermore, the recording paper 2*a* is curled in the winding direction thereof, and thus the housing path 30*d* is provided to be bent in the same direction as the winding direction of the recording paper 2*a*. This can suppress a paper jam when the recording paper 2*a* is guided into the housing path 30*d*.

The thermal printer 100 further includes the ejection path 30*e* that guides the recording paper 2*a* to the ejection opening 16, the recording paper 2*a* having passed through the second path 30*c*. The ejection opening 16 is provided with the cutter 16*a* that cuts the recording paper 2*a*. The ejection path 30*e* has a distance greater than the effective print length in the unit screen of the ink sheet 5 used in the thermal printer 100.

Therefore, the ejection path 30*e* has a distance greater than the effective print length in the unit screen of the ink sheet 5, whereby the tip of the recording paper 2*a* does not reach the ejection opening 16 upon printing on the second main surface of the recording paper 2*a*. Thus, the first main surface (namely, back side) of the recording paper 2*a* can be prevented from damage caused by the cutter 16*a* at the ejection opening 16. Since the thermal printer 100 of the preferred embodiment performs double-sided printing, printing is also performed on the surface (namely, the first main surface) of the recording paper 2*a* on the side provided with the cutter 16*a*. Therefore, it is particularly effective to prevent the first main surface of the recording paper 2*a* from damage caused by the cutter 16*a*.

In addition, according to the present invention, the above preferred embodiments can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A thermal printer, comprising:

a thermal head;

a platen roller disposed to face said thermal head;

a first path that guides recording paper drawn from a recording paper roll to one entrance of a gap between said thermal head and said platen roller such that a first main surface of said recording paper is on said thermal head side;

a second path that guides said recording paper drawn from said recording paper roll to the other entrance of the gap between said thermal head and said platen roller such that a second main surface of said recording paper is on said thermal head side; and a switch guide that switches between said first path and said second path.

2. The thermal printer according to claim 1, further comprising:

a first print operation mode of switching said switch guide to said first path and guiding said recording paper into said first path to perform printing on said first main surface of said recording paper;

a rewind operation mode of rewinding said recording paper on which printing has been performed by said first print operation mode; and a second print operation mode of switching said switch guide to said second path after said recording paper has been rewound by said rewind operation mode and guiding said recording paper into said second path to perform printing on said second main surface of said recording paper, wherein said thermal printer performs printing on both said first and second main surfaces of said recording paper being connected to said recording paper roll.

3. The thermal printer according to claim 2, further comprising a housing path that houses said recording paper on which printing has been performed by said first print operation mode, wherein said housing path is curved in the same direction as a winding direction of said recording paper roll.

4. The thermal printer according to claim 1, further comprising an ejection path that guides said recording paper to an ejection opening, said recording paper having passed through said second path, wherein said ejection opening is provided with a cutter that cuts said recording paper, and said ejection path has a distance greater than an effective print length in a unit screen of an ink sheet used in the thermal printer.

5. The thermal printer according to claim 2, further comprising an ejection path that guides said recording paper to an ejection opening, said recording paper having passed through said second path, wherein said ejection opening is provided with a cutter that cuts said recording paper, and said ejection path has a distance greater than an effective print length in a unit screen of an ink sheet used in the thermal printer.

6. The thermal printer according to claim 3, further comprising an ejection path that guides said recording paper to an ejection opening, said recording paper having passed through said second path, wherein said ejection opening is provided with a cutter that cuts said recording paper, and said ejection path has a distance greater than an effective print length in a unit screen of an ink sheet used in the thermal printer.

* * * * *